US005654521A

United States Patent [19]

McDaniel

[11] Patent Number: 5,654,521

[45] Date of Patent: Aug. 5, 1997

[54] ROCKET-FIRED VISUAL SIGNALLING APPARATUS AND METHOD EMPLOYING A STREAMER

[75] Inventor: Evan Grant McDaniel, Rosedale, Canada

[73] Assignee: Green Timbers Aviation Corporation, Rosedale, Canada

[21] Appl. No.: 453,821

[22] Filed: May 30, 1995

[51] Int. Cl.[6] ..... F42B 4/08; F42B 4/10

[52] U.S. Cl. ..... 102/348; 102/351; 102/354; 102/356; 102/357; 102/504; 102/293; 89/1.1; 89/1.34; 116/DIG. 40

[58] Field of Search ..... 89/1.34, 1.11, 89/1.1; 102/336, 337, 338, 339, 340, 343, 347, 348, 351, 354, 356, 357, 293, 504; 116/209, 210, DIG. 40, DIG. 44; 206/573, 803

[56] References Cited

U.S. PATENT DOCUMENTS

| | | | |
|---|---|---|---|
| 534,651 | 2/1895 | Krucker | 102/348 |
| 2,949,094 | 8/1960 | Clothier | 116/209 |
| 3,114,317 | 12/1963 | Estes | 102/348 |
| 3,593,664 | 7/1971 | Davis et al. | 102/337 |
| 3,795,194 | 3/1974 | Kendrick | 102/348 |
| 3,930,448 | 1/1976 | Barber et al. | 102/348 |
| 3,964,392 | 6/1976 | Kintish et al. | 89/1.34 |
| 4,300,469 | 11/1981 | Huwe | 116/209 |
| 4,505,179 | 3/1985 | Nelson et al. | 89/1 G |
| 4,724,768 | 2/1988 | Robinson et al. | 102/504 |
| 4,741,243 | 5/1988 | Snider | 89/1.34 |
| 4,917,015 | 4/1990 | Lowery | 102/357 |
| 5,000,111 | 3/1991 | Gibson | 116/209 |
| 5,099,747 | 3/1992 | Smith | 89/1.34 |
| 5,421,287 | 6/1995 | Yonover | 116/209 |
| 5,524,524 | 6/1996 | Richards et al. | 89/1.34 |

FOREIGN PATENT DOCUMENTS 2083596 7/1981 United Kingdom .

*Primary Examiner*—Michael J. Carone
*Assistant Examiner*—Theresa M. Wesson
*Attorney, Agent, or Firm*—Fetherstonhaugh & Co.

[57] ABSTRACT

A rocket-fired visual signalling apparatus and method includes a rocket, an elongated streamer having a first end portion connected to the rocket and a rocket launcher for launching the rocket so that the rocket pulls the streamer into the air such that when the rocket burns out, the streamer is spread out over the surrounding ground cover to facilitate visibility of the streamer.

27 Claims, 7 Drawing Sheets

ROCKET-FIRED VISUAL SIGNALLING APPARATUS AND METHOD EMPLOYING A STREAMER

BACKGROUND OF THE INVENTION

This invention relates to a rocket-fired visual signalling apparatus and method and more particularly to an apparatus employing a rocket to drag a streamer into the air to spread out the streamer over trees and the like for visibility by air or ground-based personnel.

Search and rescue crews appear to have difficulty in rapidly locating lost or missing people. Every year hikers, skiers and hunters etc. become lost, injured, or both, in terrain inhospitable to search and rescue crews. Typically a lost person is not declared missing for hours before a search is initiated.

After a person has been declared missing it is often too late in the day to start a search, and a full scale search usually cannot be initiated until the following day. Meanwhile, the lost person has usually been travelling on foot or on skis and only when night falls does the person come to accept that they are lost, at which time it is too dark to proceed and the person is cold, tired, and faced with spending the night outside, unprotected.

Normally, a lost person will seek the protection of heavy timber to get out of the wind and/or snow and/or rain which severely hampers any ability to be seen by a search crew. If the person has been hurt and is unable to move or relocate to an area where an air or ground search can locate them their chances of being located are remote. If the person is unconscious, a response cannot be given in the event that a searcher calls and the prospects of being located are further reduced. Events of this nature can allow searchers to pass within a very close distance of the victim with neither party becoming aware of the other.

Emergency signalling devices are available; however, each has its advantages and disadvantages. For example, flares are relatively compact to carry, but flares burn for only a few seconds, providing only a very short window of time in which to be recognized. Due to this short window, flares are difficult to see from an aircraft because if a pilot or spotters in the aircraft are not looking in the direction of the flare at the time the flare is burning, the flare will not be noticed. Emergency locator devices which emit high frequency radio signals are also available but are relatively expensive and some are bulky and impractical to carry and depend on the reliability of batteries. Other methods of signalling include balloon launched streamers; however, balloons are susceptible to being carried away by winds, cannot be used in some weather conditions and require a clear space for launching. Furthermore, the flight path of a balloon cannot be accurately controlled.

What would be desirable is a signal streamer which can be spread out above the trees and which generally stays in the vicinity of the lost person and which remains visible for a long period of time, even in high wind conditions, rain and snow, which is relatively easy to carry, which is inexpensive, and which does not rely on external power sources such as batteries. Furthermore, a device with long shelf-life and no maintenance requirement is desirable.

U.S. Pat. No. 4,741,243 to Snider discloses a line launcher for launching a line spool provided with a length of line, toward a target. This device employs a ballistic method to launch a projectile containing the line spool, from a conventional marine flare gun. However, it appears the line is of rather small gauge to be seen by air or ground rescue parties and it requires that the user carry both a flare gun and the projectile, which would be cumbersome to hikers and skiers.

U.S. Pat. No. 4,505,179 to Nelson et al. discloses a line throwing device for launching a projectile from a riot gun or similar tubular launching device. The projectile includes a shotgun primer cap and a rocket motor for launching and propelling the projectile respectively. This device employs stabilizing fins for stabilizing the flight path of the projectile and employ a bridle for evenly pulling the line. However, the stabilizing fins would make the device impractically bulky to be carried about by a hiker or skier and further would require that that person carry a rather large riot gun or other large launching device. Furthermore, the device is intended to throw a line for conventional purposes rather than a streamer for visibility purposes.

The present invention overcomes the difficulties with prior art devices and addresses the need discussed above.

SUMMARY OF THE INVENTION

According to one aspect of the invention, there is provided a rocket-fired visual signalling apparatus including a rocket, an elongated streamer having a first end portion connected to the rocket and a rocket launcher for launching the rocket so that the rocket pulls the streamer into the air such that when the rocket burns out, the streamer is spread out over the surrounding ground cover to facilitate visibility of the streamer.

Preferably, the apparatus includes a stabilizer for stabilizing the thrust force produced by the rocket for generally controlling the flight path of the rocket. The stabilizer may include an elongated rigid member secured to the rocket and a lanyard may be connected to the stabilizer for connecting the streamer to the rigid member. Preferably, the rigid member has a tapered end portion to which the lanyard is connected and preferably, the apparatus includes a pivotable connector for connecting the lanyard to the rigid member to enable the lanyard to pivot in any direction relative to the rigid member. The pivotable connector may include a swivel connector.

Preferably, the lanyard includes a piece of stainless steel wire of sufficient length to cause the streamer to be located sufficiently rearward of the rocket such that upon launching the rocket, the rocket is able to acquire sufficient momentum in the direction of launch to relatively smoothly accept the load of the streamer as the streamer is dragged by the rocket into the air. More particularly, the lanyard preferably includes a piece of stainless steel wire of sufficient length to cause the streamer to be located sufficiently rearward of the rocket such that upon launching the rocket, the streamer presents no load to the rocket until the thrust momentum is at least generally equal to the ballistic momentum such that the load due to the streamer is relatively smoothly accepted by the rocket without significantly altering the flight path of the rocket.

Preferably, the rigid member has a longitudinal axis and a locator for locating the thrust axis of the rocket relative to the longitudinal axis when the rigid member is secured to the rocket. Preferably, the rocket has a circularly cylindrical outer surface and preferably, the locator includes a curved portion on the rigid member, the curved portion being curved complementary to the outer surface of the rocket, for contacting the outer surface of the rocket and for providing rigidity to the rigid member.

The rocket has first and second opposite end portions and preferably, the rigid member has a shoulder portion for engaging the first end portion of the rocket such that a first end portion of the rocket pushes on the shoulder portion while the rocket is producing thrust, for positive transfer of energy from the rocket to the rigid member.

Preferably, the rigid member has a length sufficient to balance drag created by the streamer with a moment created by the thrust of the rocket about a natural axis of rotation of the combination of the rocket motor and rigid member.

Preferably, the rocket launcher cooperates with the rocket to produce ballistic momentum in the rocket during launch and the rocket launcher is sufficiently short to cause the ballistic momentum acquired by the rocket to be surpassed by thrust momentum due to the rocket after the rocket is free of the launcher.

Preferably, the launcher includes a component having a circularly cylindrical bore with inner and outer end portions, the outer end portion having a first opening for receiving the rocket and the inner end portion being closed, the cylindrical bore being dimensioned to cause the exhaust of the rocket emitted into the cylindrical bore to impart ballistic momentum to the rocket.

Preferably, the launcher includes a container having a flammable portion, for containing the rocket and streamer when the rocket is not in use and for facilitating smooth dispatch of the streamer when the rocket is in use. The flammable portion may also be used to assist the user in lighting a fire.

Preferably, the component containing the bore is pivotally connected to the container, to permit the bore to be oriented at various angles to the container.

Preferably, the apparatus includes steadying means connected to the launcher for steadying the launcher during launching of the rocket, the steadying means including at least one leg member.

In accordance with another aspect of the invention, there is provided a method of visual signalling, the method including the step of launching a rocket to which an elongated streamer is connected to so that the rocket pulls the streamer into the air such that when the rocket burns out, the streamer is spread out over the surrounding ground cover to facilitate visibility of the streamer.

The rocket is capable of towing the streamer to and beyond the tops of the very highest trees in a very short period of time. The streamer is preferably long and thin which permits it to function as a very high aspect air foil which is subject to flutter under the slightest breeze or wind. This flutter action causes the streamer to alternately twist and untwist along its axis. The twisting and untwisting action appears a wave along the entire length of the streamer or between any two or more fixed points there along. This twisting action alternately provides a thin edge/thick edge view of the streamer over every 360 degree twist. When viewed from any angle the streamer appears to pulsate along its entire length. This is a movement which catches the eye of any observer and is unnatural to such a degree as to cause the observer to focus attention on it.

The wind induced twisting of the streamer causes it to shed any snow or freezing rain which would cover other visibility enhancing devices. Unlike other airborne devices the wind, if present, actually helps spread the extra streamer material into the tops of trees over a greater distance while at the same time insuring that the streamer is actually in the vicinity of the user when the streamer end is attached to the launcher.

Furthermore, the apparatuses according to the embodiments described herein are light weight and may easily be carried by a hiker or skier. These apparatuses are also waterproof and they float.

BRIEF DESCRIPTION OF THE DRAWINGS

In drawings which illustrate embodiments of the invention.

DETAILED DESCRIPTION

Figure 1:
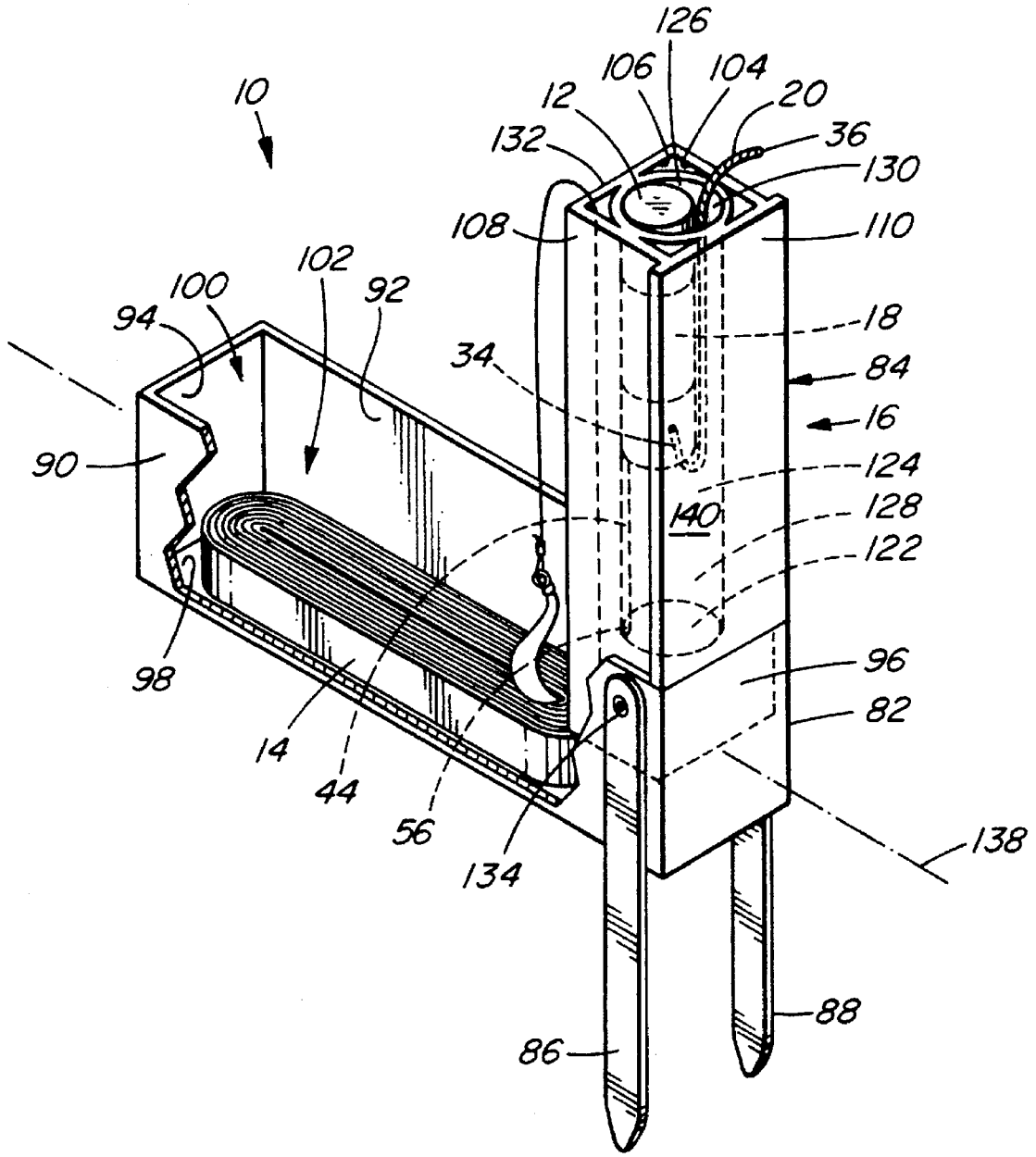
FIG. 1 is a perspective view of an apparatus according to a first embodiment of the invention.

Referring to FIG. 1, a rocket-fired visual signalling apparatus according to a first embodiment of the invention is shown generally at 10. The apparatus generally includes a rocket 12, a streamer 14 and a rocket launcher 16.

Rocket

Figure 2:
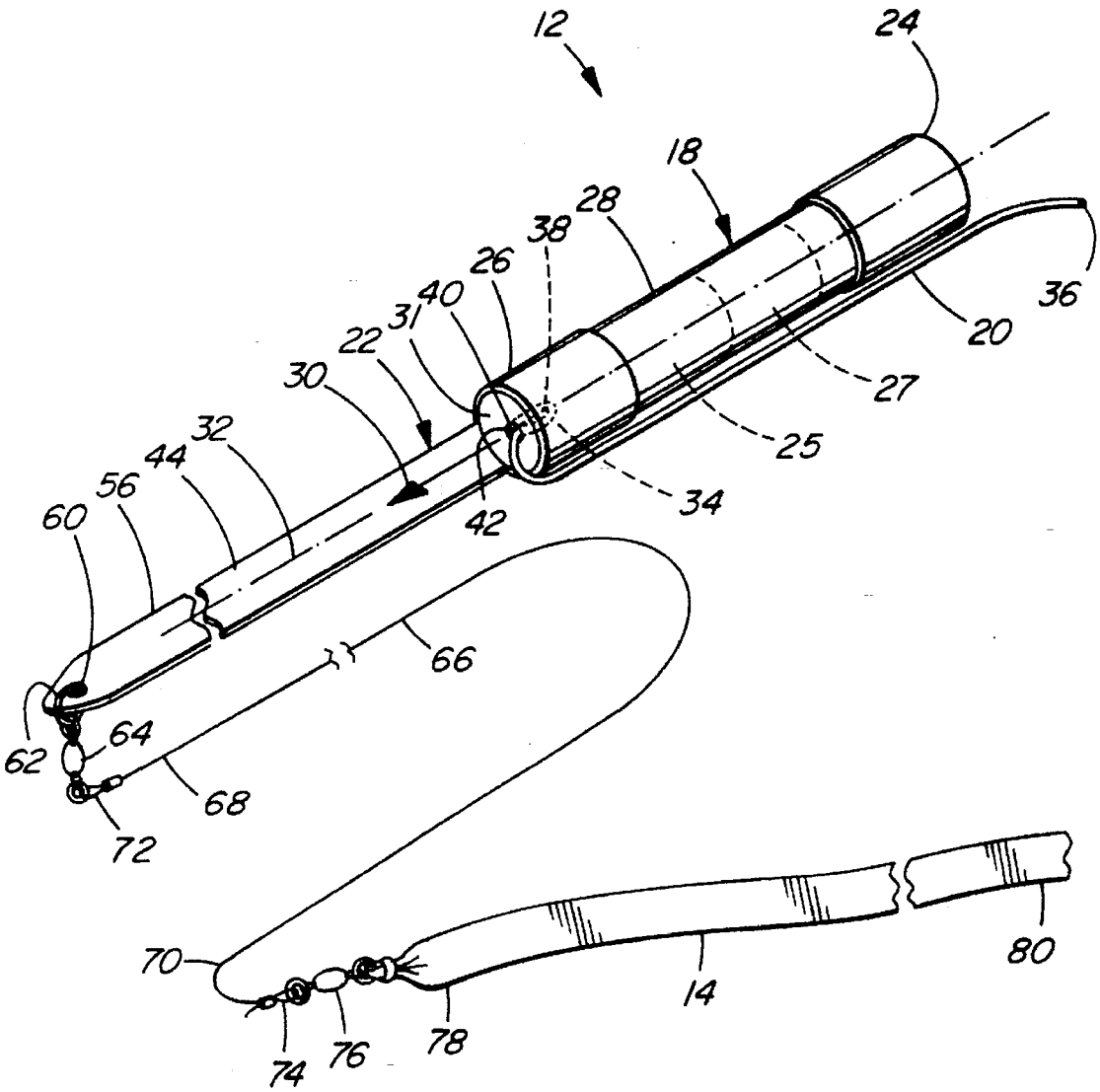
FIG. 2 is a perspective view of a rocket, lanyard and streamer according to the first embodiment of the invention.

Referring to FIG. 2, the rocket 12 includes a rocket motor 18, a fuse 20 for firing the rocket motor and a stabilizer 22 for stabilizing the flight path of the rocket.

Rocket Motor

The rocket motor 18 has first and second opposite end portions 24 and 26 and a circularly cylindrical outer surface portion 28 extending therebetween. The rocket motor used in this embodiment is an "Estes" C6-3, available from ESTES Industries of Penrose Colorado, U.S.A., and has a charge of original, conventional propellant 25 and has been modified by substituting the conventional standard eject charge (not shown) with additional conventional propellant 27 to increase the burn duration to produce a thrust curve similar to the unmodified rocket motor, but for a longer period of time. In this embodiment, after the above modification, the modified rocket motor has a total impulse of 10 Newton-second$^2$, a maximum lift weight of 4 oz. (113.2 g), a maximum thrust of 13.3 Newtons, a thrust duration of 2.1 seconds, a launch weight of 0.88 oz. (24.9 g) and a propellant charge of 0.44 oz (12.48 g).

The rocket motor used in this embodiment measures 2.75 inches (6.985 cm) long by 0.695 inches (1.765 cm) in diameter and is chosen for its light weight/thrust ratio. It has a clay end cap and a moulded clay exhaust nozzle 31 having a central, axially extending opening 40 therein.

When ignited, the rocket develops thrust along a thrust axis 30 generally coincident with a longitudinal axis 32 thereof.

Fuse

Means for igniting the original propellant 25 is provided by the fuse 20. The fuse has first and second end portions 34 and 36. The first end portion 34 is folded to form a tight hook 38 and the tight hook is inserted into the central, axially extending opening 40 until it is in direct contact with the original propellant 25. The fuse is then anchored in place using a thermosetting adhesive 42, placed between the fuse 20 and the moulded clay exhaust nozzle 31, in the central opening 40. In this embodiment, the particular adhesive used is Hardset Glue available from Bostik Canada Inc.

The second end portion 36 of the fuse 20 is routed to extend parallel to the rocket such that a portion thereof projects outwardly of the first end portion 24 of the rocket 18 to facilitate easy lighting of the fuse 20.

The fuse 20 provides a delay means for igniting the rocket motor 18, the delay being provided by the length of the fuse, which in this embodiment is approximately 6 inches (15.24 cm) long as measured between opposite end extremities. The fuse used in this embodiment is formed from THERMOLITE Slow CXA igniter cord available from CXA Ltd. of Brownsburg Quebec, Canada. The THERMOLITE fuse is preferable as it is exothermic and contains wire stranding bonded with light plastic stranding. This type of fuse is waterproof and can be easily lighted with the flame of a conventional cigarette lighter or match. This type of fuse burns on the outside and thereby is operable to ignite the original conventional propellant 25 when the tight hook 38 of the fuse burns.

Stabilizer

Figure 3:
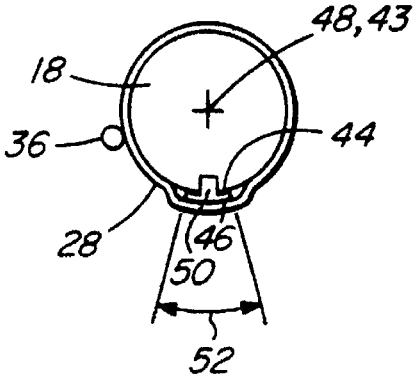
FIG. 3 is an end view of the rocket shown in FIG. 2.

The stabilizer 22 acts to stabilize the thrust force produced by the rocket motor 18 for generally controlling the flight path of the rocket and includes an elongated rigid member 44 press-formed from Extruded 6061 T-6 aluminum having a thickness of 0.035 inches (0.0889 cm) and a length of 7.25 inches (18.415 cm). Referring to FIG. 3, the material is press-formed to acquire a curved portion 46, curved complementary to the outer surface portion 28 of the rocket, about an axis of curvature 48 parallel to a longitudinal axis 50 of the rigid member 44, for contacting the outer surface portion 28 of the rocket motor 18. In this embodiment, the curved portion 46 has an outside radius of approximately 0.375 inches (0.9525 cm) and has an inside radius of approximately 0.34 inches (0.8636 cm). Preferably, the curved portion extends through an arc 52 of approximately 33.26 degrees.

The curved portion 46 acts as both a stiffener for maintaining the rigid member 44 generally in alignment with the thrust axis 43 of the rocket motor 18 during flight and as a locator for locating the rocket motor 18 relative to the rigid member 44 such that the thrust axis 43 of the rocket motor 18 is parallel to the longitudinal axis 50 of the rigid member when the rigid member 44 is secured to the rocket motor 18. In addition, the rigid member 44 serves to enable the high pressure exhaust of the rocket motor 18 to act thereon such that at least a portion of the moment created by the rocket motor about the natural axis of rotation of the assembly comprised of the rocket motor and rigid member is counteracted by the deflection of exhaust gases by the rigid member 44.

Figure 4:
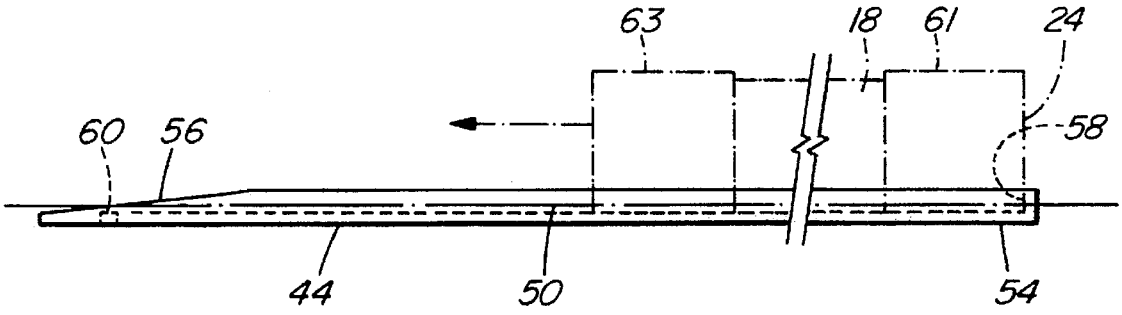
FIG. 4 is a side view of a rigid member according to the first embodiment of the invention, with a rocket motor being shown in broken outline.

Referring to FIG. 4, the rigid member 44 further has first and second end portions 54 and 56, the first end portion 54 having an upstanding shoulder portion 58 extending radially inwardly, perpendicular to the longitudinal axis 50, for engaging the first end portion 24 of the rocket motor 18 such that the first end portion 24 pushes on the shoulder portion 58 when the rocket motor 18 is producing thrust, for positive transfer of energy from the rocket motor 18 to the rigid member 44. The second end portion 56 of the rigid member 44 is tapered and has a connector opening 60 for attaching the streamer 14 to the rigid member as seen best in FIG. 2.

The rocket motor 18 is secured to the rigid member 44 by first and second bands of 1-inch (2.54 cm) wide masking tape 61 and 63 wrapped transversely around the rocket motor 18 and rigid member 44.

Referring back to FIG. 2, the connector opening 60 in the rigid member 44 is approximately ⅛ inches (0.3175 cm) in diameter and is located approximately ⅛ inches from an end extremity of the second end portion 56 of the rigid member 44. Through the connector opening 60 is secured a stainless steel split-ring connector 62 to which is secured a first stainless steel swivel connector 64. The split ring connector 62 and the swivel connector together 64 act as a pivotable connector for connecting a lanyard 66 to the rigid member 44 to enable the lanyard to pivot in any direction relative to the rigid member.

Lanyard

In this embodiment, the lanyard 66 is formed from a 24-inch (60.96 cm) length of 60# braided stainless steel wire. The length of wire has first and second opposite end portions 68 and 70, each of which is bent and crimped to form first and second loops 72 and 74 respectively. The first loop 72 is connected to the first swivel connector 64 and the second loop 74 is connected to a second swivel connector 76 which is connected to a first end portion 78 of the streamer 14. The lanyard 66 thus serves to connect the streamer 14 to the rigid member 44 and the split ring connector 62 and first swivel connector 64 serve to rapidly change direction relative to the rocket during launching and to keep the lanyard 66 out of the direct line of exhaust gases emitted from the rocket motor 18 in flight.

Streamer

The streamer 14 is generally elongated and in this embodiment it has a length of approximately 328 feet (100 meters), a width of approximately 0.75 inches (1.905 cm) and a thickness of 0.00875 inches (0.22 mm). The streamer thus has a very high ratio (ratio of length to width). This high aspect ratio, with the relatively small thickness of the streamer keep the weight of the streamer to a minimum. In this embodiment, preferably the thickness is less than 0.01 inches (0.254 mm), While the first end portion 78 of the streamer is connected to the lanyard 66, the streamer 14 also has a second end portion 80 which may be free or which may be connected to the rocket launcher 16, shown in FIG. 1. In this embodiment, the streamer 14 is made from a plastic material known as ALASKA 60 available from Flagging & What Inc. of Edmonton, Alberta, Canada. This material has a temperature range of −76 F. to 284 F. (−60 C. to +140 C.), over which it remains flexible and resilient. Preferably, for emergency signalling uses, the streamer is international orange in colour.

Rocket Launcher

Referring back to FIG. 1, the rocket launcher 16 is for launching the rocket 12 so that the rocket pulls the streamer 14 into the air such that when the rocket motor burns out, the streamer is spread out over the surrounding ground cover to facilitate visibility of the streamer.

In this embodiment, the rocket launcher 16 includes a container 82, a launch tube 84 for launching the rocket, and first and second leg members 86 and 88 which act as steadying means for steadying the launcher during launching of the rocket.

Container

In this embodiment, the container 82 is formed from moulded, transparent polypropylene plastic to have a generally rectangular parallelepiped outer profile. This material is flammable and presents the user with the option of lighting the container on fire to kindle a larger fire, after the rocket has been launched.

The container 82 has first and second spaced apart side portions 90 and 92 joined together by first and second opposite end portions 94 and 96 and a long edge portion 98. A rectangular opening 100 is defined by respective edges of the first and second side portions and first and second end portions 94 and 96, opposite the long edge portion 98. The container thus has a rectangular parallelepiped shaped compartment 102 therein.

Launch Tube

Figure 5:
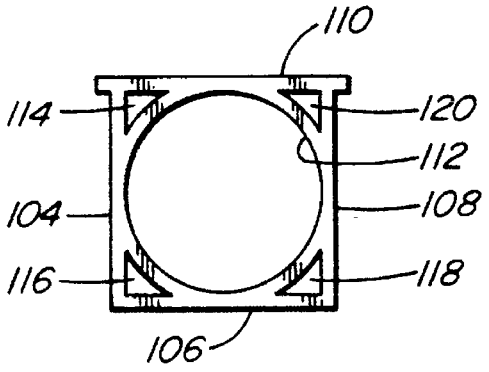
FIG. 5 is an end view of a rocket launch tube according to the first embodiment of the invention.

The launch tube 84 has first, second, third and fourth rectangular flat planar portions 104, 106, 108 and 110 which are connected together to form a generally rectangular parallelepiped outer profile when viewed from a side and a generally square outer profile when viewed from an end as seen in FIG. 5. Referring to FIGS. 1 and 5, the launch tube further has a cylindrical portion 112 formed within the rectangular flat planar portions within the square outer profile and extending generally the length of the launch tube. First, second, third and fourth generally triangularly cylindrical spaces 114, 116, 118 and 120 are formed between the cylindrical portion 112 and respective rectangular sides of the launch tube.

Referring to FIG. 1, the cylindrical portion 112 has a flat, disk shaped bottom portion 122 which seals the cylindrical portion such that the cylindrical portion and bottom portion define a longitudinal, circularly cylindrical bore 124 having an outer, open end portion 126 and a closed, inner end portion 128. The open end portion 126 has a first opening 130 for receiving the rocket and lies in an end plane 132 coincident with respective edges of the first, second, third and fourth rectangular side portions 104, 106, 108 and 110. The distance between the open end portion and the closed bottom portion defines the length of the bore 124.

In this embodiment the length of the bore is generally equal to the length of the rocket and the diameter of the bore is slightly larger than the diameter of the rocket motor 18. In this embodiment, the length of the bore is 7.25 inches (18.415 cm) and the diameter of the bore is 1-inch (2.54 cm). This enables the rocket 12 to be placed in the bore such that the second end portion 56 of the rigid member 44 is operable to rest on the disk shaped bottom portion 122 while the first end portion 24 of the rocket motor 18 is generally co-planar with the end plane 132. This allows the user to gain access to the second end portion 36 of the fuse 20 for lighting while the rocket is in the launch tube 84.

Figure 6:
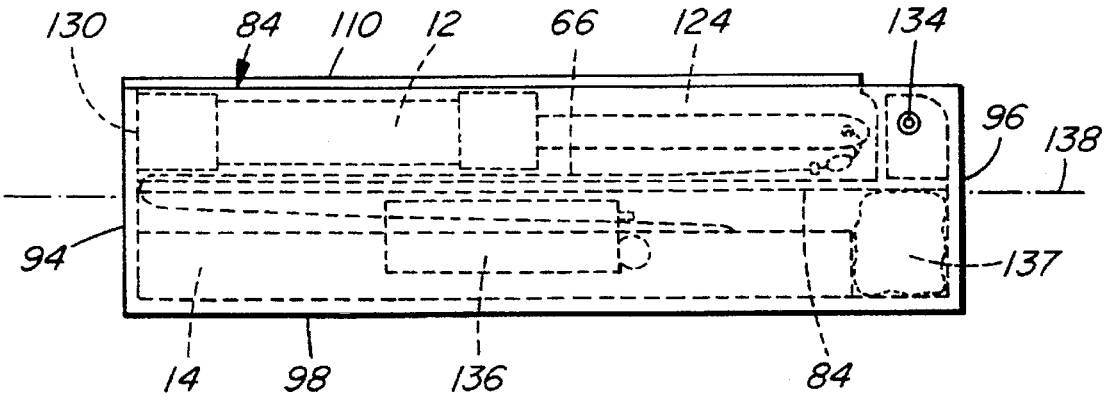
FIG. 6 is a side view of a rocket launcher, shown in a closed position, according to the first embodiment of the invention.

The launch tube 84 is pivotally secured to the first and second side portions 90 and 92 of the container by first and second rivets, only the first of which is shown at 134. The first and second rivets are coaxially positioned such that the launch tube 84 is operable to pivot relative to the container 82 to permit the tube 84 to be oriented at various angles to the container 82 including a launch position in which the launch tube 84 is directed away from the container 82 (as shown in FIG. 5) and a storage position in which the launch tube 84 is received between the first and second side portions such that the fourth rectangular side portion 110 of the launch tube forms a second opposite edge portion extending between the first and second side portions and between the first and second end portions, as shown in FIG. 6. The launch tube therefore serves to close the container when the apparatus is not in use.

The container is formed such that when the launch tube is in the storage position, sufficient space is provided within the container to contain the streamer 14 and a small cigarette lighter 136 and packing 137 including cotton and silica gel for absorption of moisture. The cigarette lighter may be of the type available from BIC Industries Ltd.

The streamer 14 is wrapped in either a coil arrangement or in a firemen's wrap to ensure it is smoothly dispatched from the container when pulled by the rocket. Any wrapping method will suffice, provided the streamer is able to be smoothly dispatched and remains untangled during dispatch.

The rocket 12 is stored in the launch tube 84 and the lanyard 66 connected to the rocket is routed toward the first opening 130 of the cylindrical bore 124 and any excess material of the lanyard is gathered in a loop and placed in any of the triangular cylindrical spaces (114, 116, 118 and 120 in FIG. 5). This prevents the lanyard 66 from getting caught on the container 82 or on the streamer 14 during launch.

Steadying Means

Referring back to FIG. 1, the first and second leg members 86 and 88 are secured to the outside of the container 82, on opposite sides thereof, by the first (134) and second rivets respectively. The first and second leg members 86 and 88 are thus pivotally secured to the container such that they may be rotated about respective rivets into a position, say, 90 degrees relative to a longitudinal axis 138 of the container 82. The first and second leg members 86 and 88 may be pressed into the ground to anchor the launcher 16 to the ground. Preferably, the first and second legs are also bendable such that they may be bent to conform to an object such as a tree branch or the like (not shown). The first and second leg members 86 and 88 may be formed from portions of sheet aluminum having a thickness of approximately 0.1625 inches (1.5875 mm).

Preferably, the apparatus will be stored with the launch tube 84 in the closed position as shown in FIG. 6, with the first and second leg members 86 and 88 stored parallel, closely adjacent the container and generally aligned with the longitudinal axis 18. (The first and second leg members 86 and 88 not shown in FIG. 6.) It is also desirable to seal the container 82 with plastic shrink wrap material (not shown) to render the unit water-tight.

Operation

Referring to FIG. 1, to use the apparatus, a user unwraps the container 82 from the plastic shrink wrap (not shown) and pivots the first and second leg members 86 and 88 about respective rivets, for securing to an object. Assuming the object is relatively soft penetrable soil (not shown), the first and second leg members 86 and 88 may be pressed to extend into the soil until the long edge portion 98 of the container abuts the soil.

The user then pivots the rocket launch tube 84 relative to the container 82 until the launch tube 84 is placed at the desired launch angle as shown in FIG. 1.

The user then reaches into the container 82 for the cigarette lighter (not shown in FIG. 1), strikes the lighter and lights the second end portion of the fuse 20. The fuse then burns toward the first end portion 34, the length of the fuse providing an approximately 6 second delay before the rocket propellant is ignited by the burning fuse, which gives the user some time to clear the area.

When the rocket propellant is ignited, exhaust gases are rapidly emitted from the rocket motor which create a high pressure area 140 inside the bore 124. This high pressure area 140 imparts ballistic momentum to the rocket 12, effectively shooting the rocket out of the launcher 16, in a manner similar to a bullet shot from a gun. Thus it will be appreciated that it is important to keep the diameter and length of the cylindrical bore to their respective minimums while providing enough clearance between the rocket and the cylindrical portion to enable free movement of the rocket therein in order to derive the greatest ballistic effect from the high pressure created by the initial emission of exhaust gas from the rocket motor 18. The rocket launcher 16 thus cooperates with the rocket motor 18 to produce ballistic momentum in the rocket 12 during launch and more particularly, the cylindrical bore 124 is dimensioned to cause the exhaust of the rocket motor 18 emitted into the cylindrical bore to impart ballistic momentum to the rocket 12.

Figure 7:
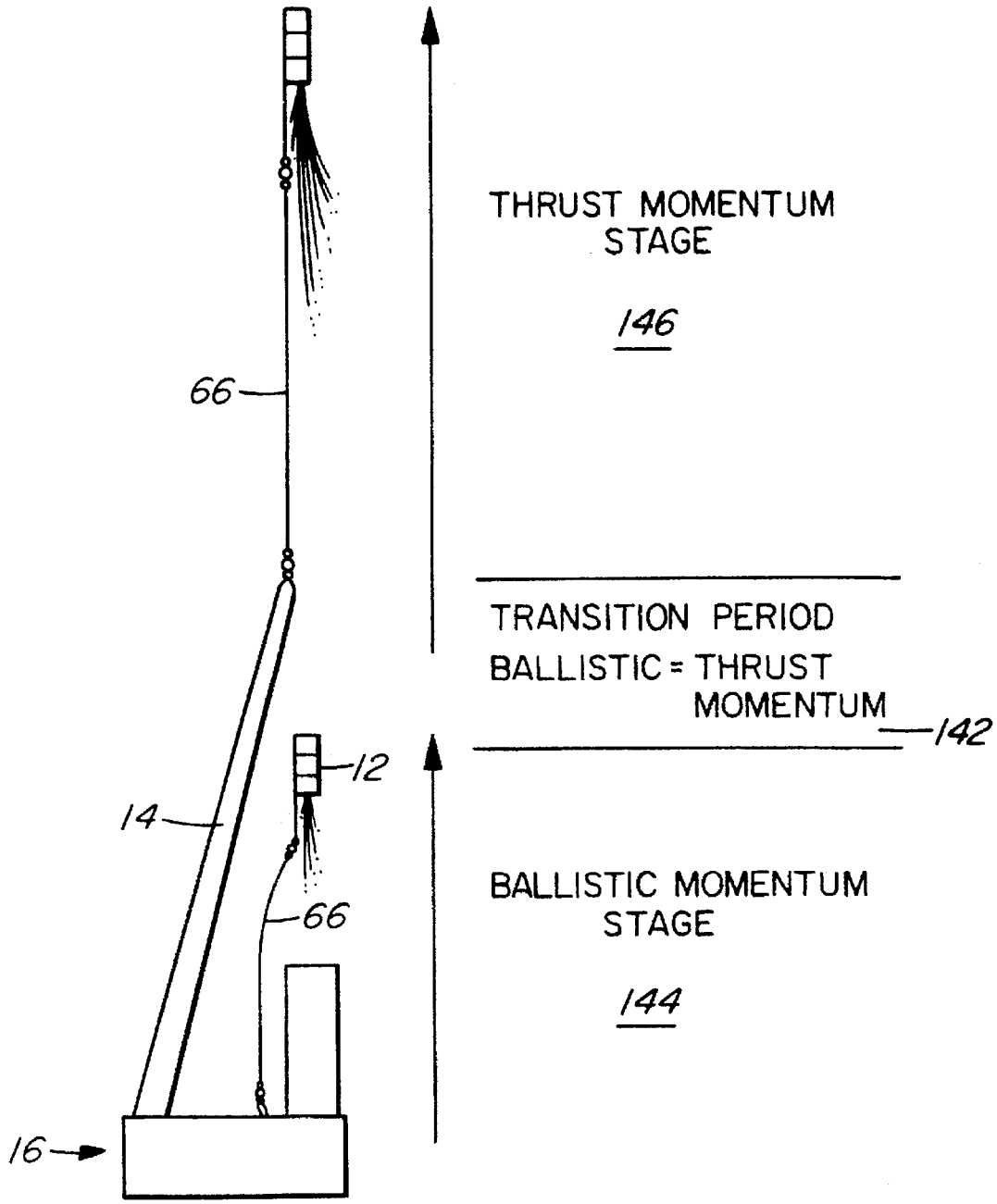
FIG. 7 is a schematic diagram illustrating a transitional period in which the rocket shown in FIGS. 2 and 3 loses ballistic momentum and gains thrust momentum.

Referring to FIG. 7, while the initial momentum imparted to the rocket 12 is ballistic momentum, this ballistic momentum soon dissipates within about 18 inches (45.72 cm.) from the launcher. However, by this time, the thrust produced by the exhaust gas has risen to a sufficient level to maintain flight of the rocket 12 and takes over as the dominant source of thrust. With the given dimensions of the launcher and with the thrust curve of the rocket motor, there is a period of transition 142 wherein the ballistic momentum of the rocket is decreasing and the thrust momentum is increasing. It is preferable that the streamer 14 present no load on the rocket 12 until the thrust momentum is generally equal to or surpasses the ballistic momentum. This delay in loading is facilitated by the length of the lanyard 66 which is drawn out of the triangular cylindrical space during the ballistic momentum stage 144 and which is preferably fully extended when the thrust momentum stage 146 begins, so as to gradually load the rocket With the drag and weight of the streamer 14 as the rocket 12 gains altitude. Thus, the lanyard 66 is of sufficient length to cause the streamer 14 to be located sufficiently rearward of the rocket 12 such that upon launching the rocket 12, the streamer 14 presents no load to the rocket 12 until the thrust momentum is at least generally equal to the ballistic momentum such that the load due to the streamer 14 is relatively smoothly accepted by the rocket 12 without significantly altering the flight path of the rocket 12. The rocket 12 is thus able to acquire sufficient momentum in the direction of launch to relatively smoothly accept the load of the streamer 14 as the streamer is dragged by the rocket 12 into the air.

Referring back to FIG. 1, preferably, the interior surfaces of the respective components 90, 92, 94, 96 and 98 forming the container 82 are smooth to facilitate smooth dispatch of the streamer 14 as the rocket 12 gains altitude.

Figure 8:
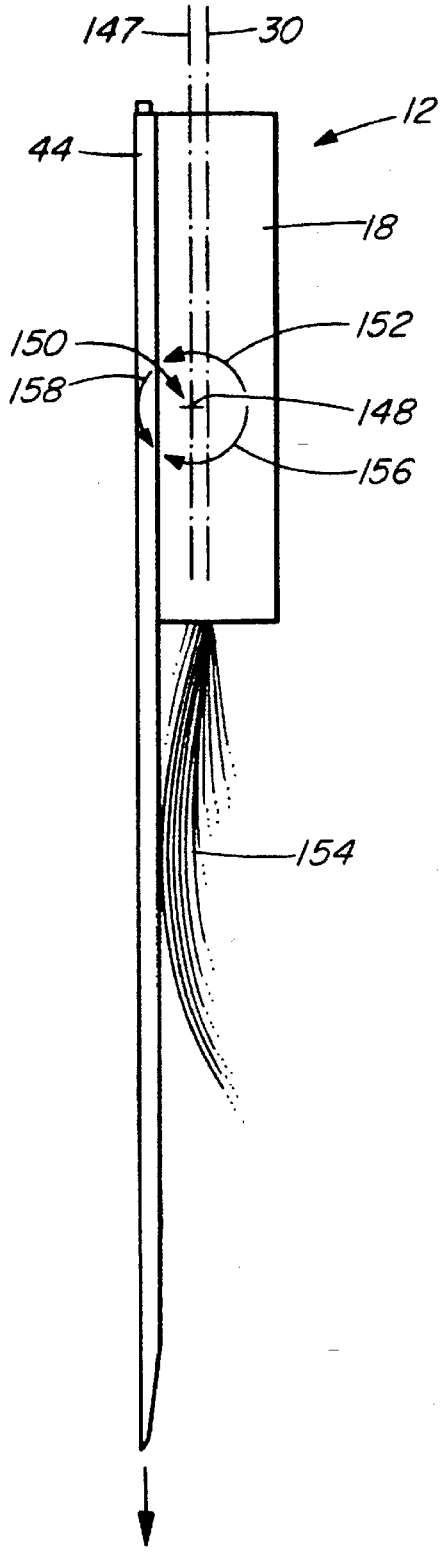
FIG. 8 is a schematic diagram illustrating moments created about a transverse natural axis of the rocket shown in FIGS. 2 and 3.

Referring to FIG. 8, the rocket motor 18, and rigid member 44 collectively act as the "rocket 12." The rocket 12 has a natural transverse axis of rotation 148 extending through its centre of mass 150.

As the rocket 12 flies through the air, the rocket motor 18 produces thrust along the thrust axis 30, which is slightly displaced from a natural longitudinal axis of rotation 147 also extending through the centre of mass 150, due to the weight of the rigid member and the masking tape. The thrust force acting at this slight displacement from the natural axis creates a moment 152 about the transverse natural axis 148, tending to rotate the rocket 12 counter clockwise about this axis. At the same time however, a portion of the exhaust gas 154 emitted from the rocket motor 18 acts upon the rigid member 44 which creates a moment 156 in the opposite, clockwise direction, also about the transverse natural axis 148. A further moment 158 is created in a clockwise direction about the same transverse natural axis 148 by the weight and drag of the streamer (not shown). The combined effect of the moment 158 produced by the streamer and the moment 152 created by the off-axis thrust is balanced by the moment 156 produced by the exhaust gas 154 acting on the rigid member 44 to cause the rocket 12 to generally maintain the desired flight path. Referring to FIGS. 3 and 8, generally it has been found that the curved portion of the rigid member 44 may extend through an arc of between 25 and 45 degrees, however, the greater the arc, the more the exhaust gases act on the rigid member, thereby increasing the gaseous thrust moment 156 to cause the trajectory of the rocket 12 to curve in a direction away from the rigid member 44, ie., to the right in the drawing, and the lesser the arc, the more the trajectory curves in a direction toward the rigid member 44 (ie to the left in the drawing).

Referring back to FIG. 3, the rocket has a relatively small end profile which allows it to penetrate openings between leaves in trees, allowing the rocket 12 to be launched in a relatively densely populated wooded area.

The rocket 12 thus drags the streamer high into the air until all rocket propellant is expended, at which time the streamer 14 is expected to be fully extended and the rocket falls back to the ground. The rocket 12 will generally fall back to the ground in a long arc, especially if it is tethered to the ground by virtue of the second end portion 80 of the streamer 14 being connected to the launcher. This arcing action causes streamer 14 to be laid across the top of the forest canopy with the rocket 12 serving to anchor the streamer 14 in the tops of the trees.

Figure 9:
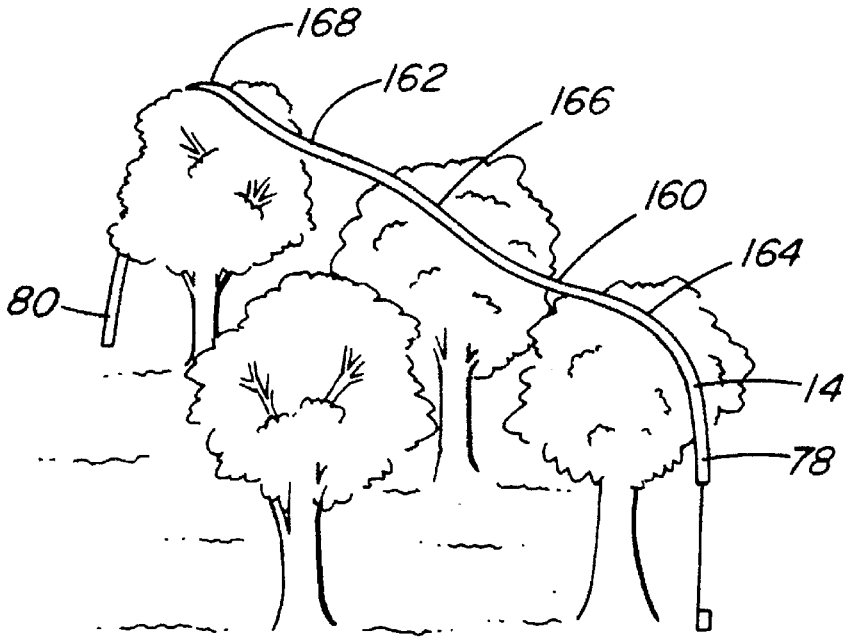
FIG. 9 is a schematic diagram of a streamer according to the first embodiment of the invention, shown spread out over a plurality of trees in a forest.

Referring to FIG. 9, as the rocket falls, it pulls the first end portion 78 of the streamer 14 with it, however, it is expected that portions 160 and 162 of the streamer 14 intermediate the end portions 78 and 80 will become entangled over the tops of the trees. Generally, from the ground location of the user to the top of the forest canopy several hundred feet above and several hundred feet across the top of the canopy the streamer is highly visible to both ground-based and airborne search personnel.

The streamer 14 will however, only become entangled at specific, random locations 164, 166 and 168 along its length which define nodes of limited displacement. Between these nodes, the portions 160 and 162 of the streamer 14 are free to flutter and twist in the wind, along the axis of the respective portion, creating a wave-like effect in respective portions. This wave-like effect causes the portions 160 and 162 to present a light reflecting surface having a rapidly varying angle which produces unnatural lighting effects which stand out from the natural background movement of trees and branches. The streamer is thus more readily noticed when viewed from a distance above, such as by a search aircraft or when viewed from the ground such as by a land-based rescue party.

The streamer 14 will generally remain in place until removed or until it breaks down from ultraviolet ray damage. Ultraviolet rays can be expected to breakdown the streamer in about two years after deployment.

Alternatives

Alternatively, the launch tube 84 may be formed by a length of suitably sized aluminum tubing (not shown), where the inner wall of the tubing defines the bore. A wooden plug may be inserted into the tubing to close an end portion thereof.

An alternative embodiment according to the invention employs a rocket generally similar to that shown in FIG. 2 with the exception that a larger rocket motor is used to pull two streamers into the air. The larger rocket motor is a stock "Estes" model D-11P having a propellent weight of 24.91 g, an initial weight of 44 grams, a thrust duration of 1.82 seconds and a maximum thrust of 27.6 Newtons. The stabilizer is generally the same as that described in connection with the first embodiment with the exception that the radius of curvature is larger, (0.5 inches), to conform to the outer profile of the D-11P rocket motor.

The rocket launcher is also suitably increased in size to accommodate the larger rocket motor and the greater quantity of streamer.

Figure 10:
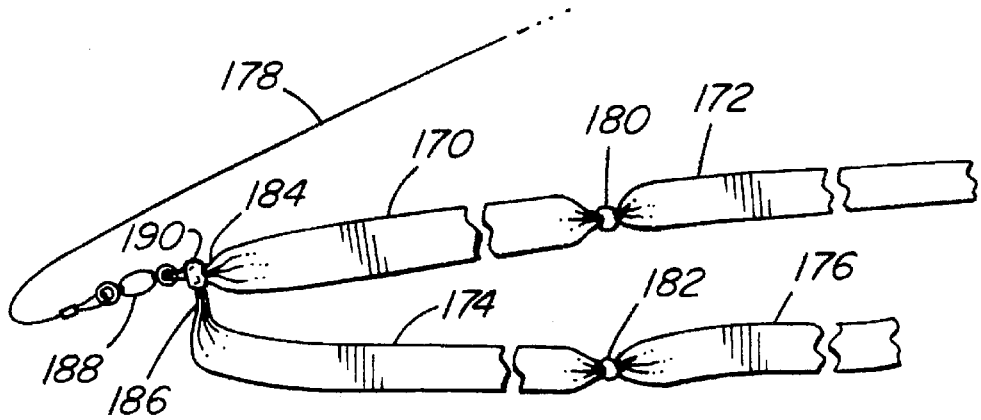
FIG. 10 is a fragmented perspective view of an apparatus according to a second embodiment of the invention.

Referring to FIG. 10, the larger rocket motor is able to pull into the air, first, second, third, and fourth streamers 170, 172, 174 and 176, of the type discussed with respect to the first embodiment. In this embodiment, a 36-inch (1 m) lanyard 178 is used between the stabilizer (not shown) and the streamers to ensure the load due to the streamers is imposed on the rocket after the rocket acquires sufficient thrust momentum.

To simplify packing of the streamers into the container (not shown), each streamer is 328 feet (100 meters) long and is separately wrapped using one of the wrapping methods disclosed with respect to the first embodiment. The second and fourth streamers 172 and 176 are stacked in the container parallel to each other and the first and third streamers 170 and 176 are placed on top of the second and fourth streamers 172 and 176 respectively.

The first and second streamers 170 and 172 are joined by tying together respective end portions of the streamers using a first knot 180, as are the third and fourth streamers 174 and 176 tied together using a second knot 182. Leading end portions 184 and 186 of the first and third streamers 170 and 174 are tied together and tied to a second swivel connector 188 by a third knot 190. The first and second streamers 170 and 172 are thus pulled by the rocket in parallel with the third and fourth streamers 174 and 176. The first and second streamers 170 and 172 and the third and fourth streamers 174 and 176 thus act as respective pairs of streamers with the respective streamers of each pair being connected in series.

In this embodiment, the larger rocket is used to pull into the air effectively two approximately 650 foot (198 m) lengths of streamer material thereby increasing the amount of streamer material which can be noticed by an observer in an aircraft or on the ground.

The apparatus according to the present invention is most effective if used as soon as a lost person realizes that they are lost, or injured. The streamer 14 functions after deployment until the person is found, with no further action being required by the person deploying the apparatus. The streamer is visible in snow, rain, high winds, low temperatures or high temperatures, hard ground cover or soft ground cover, and it has the ability to shed snow and freezing rain. The apparatus can be used by an injured person as it can be operated with one hand and it can be operated within the reach area of a severely injured person.

While specific embodiments of the invention have been described and illustrated, such embodiments should be considered illustrative of the invention only and not as limiting the invention as construed in accordance with the accompanying claims.

What is claimed is:

1. A visual signalling apparatus comprising:

a) a rocket having a rocket motor for producing discharged gases for propelling said rocket to produce thrustual momentum in said rocket;

b) an elongated streamer having a first end portion connected to said rocket and a second end portion free of said rocket; and c) a rocket launcher cooperating with said discharged gases for imparting ballistic momentum to said rocket while said rocket is in said launcher so that said rocket extends said streamer as said rocket ascends, by dragging the first end portion of said streamer aloft while said second end portion remains free of said rocket.

2. An apparatus as claimed in claim 1 further including a stabilizer for stabilizing the thrust force produced by said discharged gases, for generally controlling the flight path of said rocket.

3. An apparatus as claimed in claim 2 wherein said stabilizer includes an elongated rigid member secured to said rocket and a lanyard for connecting said streamer to said rigid member.

4. An apparatus as claimed in claim 3 wherein said rigid member has a longitudinal axis and a locator for locating the thrust axis of the rocket relative to said longitudinal axis when said rigid member is secured to said rocket.

5. An apparatus as claimed in claim 4 wherein said rocket has a circularly cylindrical outer surface and wherein said locator includes a curved portion on the rigid member, said curved portion being curved complementary to said outer surface of said rocket, for contacting the outer surface of said rocket.

6. An apparatus as claimed in claim 5 wherein said rocket has first and second opposite end portions and wherein said rigid member has a shoulder portion for engaging said first end portion of said rocket such that a first end portion of said rocket pushes on said shoulder portion while said rocket is producing thrust, for positive transfer of energy from said rocket to said rigid member.

7. An apparatus as claimed in claim 3 wherein said rigid member has a tapered end portion to which said lanyard is connected.

8. An apparatus as claimed in claim 7 wherein said rigid member has a stiffener for maintaining the rigid member generally in alignment with a thrust axis of said rocket during flight.

9. An apparatus as claimed in claim 8 wherein said stiffener includes a curved portion on the rigid member, said curved portion being curved about an axis parallel to the longitudinal axis of said rigid member.

10. An apparatus as claimed in claim 9 wherein said rigid member has a length sufficient to balance drag created by said streamer with a moment created by the discharged gases acting on the rigid member about a natural axis of rotation of the combination of said rocket and rigid member.

11. An apparatus as claimed in claim 3 further including a pivotable connector for connecting said lanyard to said rigid member to enable said lanyard to pivot in any direction relative to said rigid member.

12. An apparatus as claimed in claim 11 wherein said pivotable connector includes a swivel connector.

13. An apparatus as claimed in claim 12 wherein said lanyard includes a piece of stainless steel wire of sufficient length to cause said streamer to be located sufficiently rearward of said rocket such that upon launching said rocket, said rocket is able to acquire sufficient momentum in the direction of launch to relatively smoothly accept the load of said streamer as said streamer is dragged by the rocket into the air.

14. An apparatus as claimed in claim 1 wherein said rocket launcher is dimensioned to cause the ballistic momentum acquired by said rocket to be surpassed by the thrustual momentum after said rocket is free of said launcher.

15. An apparatus as claimed in claim 14 wherein said lanyard is of sufficient length to cause said streamer to be located sufficiently rearward of said rocket such that upon launching said rocket, said streamer presents no load to said rocket until said thrustual momentum is at least generally equal to said ballistic momentum such that the load due to said streamer is relatively smoothly accepted by said rocket without significantly altering the flight path of the rocket.

16. An apparatus as claimed in claim 1 wherein said launcher has a cylindrical bore.

17. An apparatus as claimed in claim 16 wherein said bore is circularly cylindrical.

18. An apparatus as claimed in claim 17 wherein said cylindrical bore has inner and outer end portions, said outer end portion having a first opening for receiving said rocket and said inner end portion being closed, said cylindrical bore being dimensioned to cause said discharged gases from said rocket motor to be emitted into said cylindrical bore to build pressure behind shad rocket to impart ballistic momentum to said rocket.

19. An apparatus as claimed in claim 18 wherein said rocket launcher includes a length of tubing having said bore.

20. An apparatus as claimed in claim 19 wherein said tube is pivotally connected to said container, to permit said tube to be oriented at various angles to said container.

21. An apparatus as claimed in claim 1 wherein said launcher includes a container for containing the rocket and streamer when the rocket is not in use.

22. An apparatus as claimed in claim 21 wherein said container includes a flammable portion.

23. An apparatus as claimed in claim 1 further including steadying means connected to the launcher for steadying the launcher during launching of the rocket.

24. An apparatus as claimed in claim 23 wherein said steadying means include at least one leg member.

25. An apparatus as claimed in claim 1 wherein said streamer has a high aspect ratio.

26. An apparatus as claimed in claim 25 wherein said streamer has a thickness of less than about 0.01 inches.

27. A method of visual signalling, the method including the steps of:

a) producing a rapid discharge of gases from a rocket motor on a rocket inside a rocket launcher such that said discharge of gases cooperates with said rocket launcher to impart ballistic momentum to said rocket;

b) maintaining said discharge for a period of time to produce thrustual momentum in said rocket to carry said rocket aloft while dragging a first end portion of a streamer attached to said rocket into the air while a second end portion of said streamer remains free such that said streamer is carried aloft and spread out for visibility.

* * * * *